US010597865B2

(12) United States Patent
Erlebach

(10) Patent No.: US 10,597,865 B2
(45) Date of Patent: Mar. 24, 2020

(54) SYSTEM AND METHOD FOR RECESSING A SUBFLOOR AND SHOWER STALL WITH A RECESSED SUBFLOOR FLOOR

(71) Applicant: Josef Erlebach, Siverthorne, CO (US)

(72) Inventor: Josef Erlebach, Siverthorne, CO (US)

( * ) Notice: Subject to any disclaimer, the term of this patent is extended or adjusted under 35 U.S.C. 154(b) by 128 days.

(21) Appl. No.: 15/959,447

(22) Filed: Apr. 23, 2018

(65) Prior Publication Data

US 2019/0323224 A1 Oct. 24, 2019

(51) Int. Cl.

| | |
|---|---|
| ***E04B 1/00*** | (2006.01) |
| ***E04B 1/41*** | (2006.01) |
| ***A47K 3/40*** | (2006.01) |
| *E04B 1/38* | (2006.01) |

(52) U.S. Cl.

CPC ..... *E04B 1/40* (2013.01); *A47K 3/40* (2013.01); *E04B 2001/405* (2013.01)

(58) Field of Classification Search

CPC ..... E04B 1/40; E04B 2001/405; E04B 2001/2415; E04B 5/12; E04B 2001/2644; E04B 1/64; A47K 3/40; A47K 3/405

USPC ..... 51/712; 4/613

See application file for complete search history.

(56) References Cited

U.S. PATENT DOCUMENTS

| | | | | | |
|---|---|---|---|---|---|
| 876,399 | A * | 1/1908 | Robinson | E04B 1/41 | 52/714 |
| 1,130,722 | A * | 3/1915 | Fletcher | E04B 2/58 | 52/355 |
| 2,779,978 | A * | 2/1957 | Sundelin | E04F 13/0844 | 52/479 |
| 3,210,898 | A * | 10/1965 | Kurtz | E04B 1/2608 | 52/281 |
| 4,159,604 | A | 7/1979 | Burrell | | |
| 4,879,856 | A | 11/1989 | Jones | | |
| 5,653,079 | A * | 8/1997 | Loeffler | E04B 1/2608 | 403/396 |
| 5,966,893 | A * | 10/1999 | Quillin | F16B 5/0028 | 52/282.2 |
| 6,101,780 | A * | 8/2000 | Kreidt | E04B 1/2608 | 52/281 |
| 6,415,575 | B1 * | 7/2002 | Thompson | E04B 1/2608 | 52/712 |
| 7,051,484 | B2 * | 5/2006 | Nanayakkara | E04B 1/165 | 52/309.12 |
| 7,617,648 | B2 * | 11/2009 | Moody | E04B 2/7457 | 52/481.1 |
| 8,011,153 | B2 * | 9/2011 | Orchard | E04F 15/02 | 24/295 |
| 9,534,374 | B1 | 1/2017 | Mogck | | |
| 9,890,533 | B2 * | 2/2018 | Nanayakkara | E04O 3/32 | |
| 2005/0258722 | A1 | 11/2005 | Sullivan | | |

(Continued)

FOREIGN PATENT DOCUMENTS

| | | | | |
|---|---|---|---|---|
| GB | 2394757 | A * | 5/2004 | E04B 5/12 |

*Primary Examiner* — Beth A Stephan

(74) *Attorney, Agent, or Firm* — Leyendecker & Lemire, LLC

(57) ABSTRACT

A set of differently configured brackets that when secured to one or more of the floor joists, wall edges and existing subfloor lower the subfloor a predetermined amount are described. The predetermined amount is typically sufficient to permit the installation of a shower pan of appropriate slope towards a drain and permit a curb-less transition between the surrounding floor and the shower stall floor.

17 Claims, 6 Drawing Sheets

(56) References Cited

U.S. PATENT DOCUMENTS

| | | | | |
|---|---|---|---|---|
| 2011/0041418 | A1* | 2/2011 | Meserini | E03C 1/01 52/79.9 |
| 2012/0079652 | A1 | 4/2012 | Lemire | |
| 2015/0337531 | A1 | 11/2015 | Cave et al. | |

* cited by examiner

SYSTEM AND METHOD FOR RECESSING A SUBFLOOR AND SHOWER STALL WITH A RECESSED SUBFLOOR FLOOR

BACKGROUND

Traditionally shower pans used in shower stalls are installed on top of a bathroom subfloor. As is typical, shower pans of all types, whether prefabricated or custom configured for a particular space, comprise a surface that is gently sloped towards a drain outlet. The need for a slope and the thickness of the materials comprising the shower pan have a distinct thickness. Further, especially in the instance of a custom shower pan, finish flooring material is installed on top of the shower pan surface adding additional thickness.

Because of the added thickness of the shower pan over the surrounding bathroom floor, there usually must be a lip at the intersection of the pan with the surrounding floor to both provide for a visual transition for a shower user and to contain water from the shower in the stall. These lips can detract from the aesthetics of a shower stall, and even more significantly hinder access to and from the shower by the disabled and elderly.

While processes for recessing the subfloor of a bathroom in the region over which a shower pan is to be installed are known, they are usually very labor intensive, and accordingly expensive. Furthermore, if the recessed subfloor is not properly installed, which typically comprises wood bracing and blocking, the load carrying capacity of the recessed floor might not be adequate to handle the loads incident on it.

DETAILED DESCRIPTION

Figure 1:
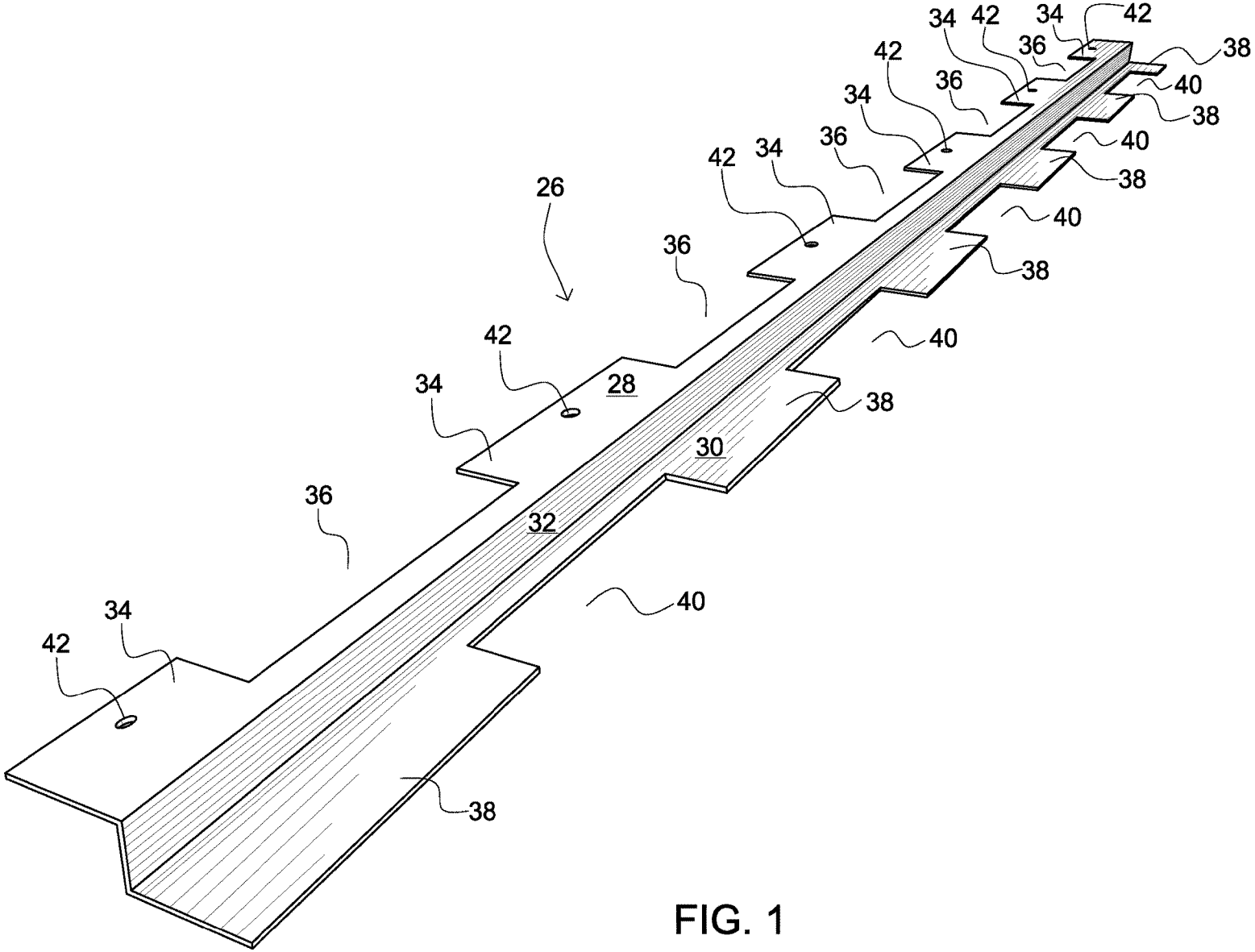
FIG. 1 is a perspective view of a main bracket used to attach a lowered subfloor to a floor joist according to one embodiment of the present invention.

Embodiments of the present invention include a set of differently configured brackets that when secured to one or more of the floor joists, walls and existing normal height subfloor lower the subfloor a predetermined amount. The predetermined amount is typically sufficient to permit the installation of a shower pan of appropriate slope towards a drain and permit a curb-less transition between the surrounding floor and the shower stall floor. In one version, the lowered subfloor sits about 9/16" below the surrounding subfloor.

One embodiment of the system comprises three different types of brackets: (i) a main bracket for attachment to a floor joist; (ii) an L-bracket for attachment to a adjacent wall; and (iii) a Z-bracket for attachment to the intersection with a surrounding normal height subfloor. The brackets are typically comprised of steel but can be made of aluminum or a fiber reinforced plastic in variations.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment", "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Set of Brackets for Recessing a Subfloor in a Room

Figure 2:
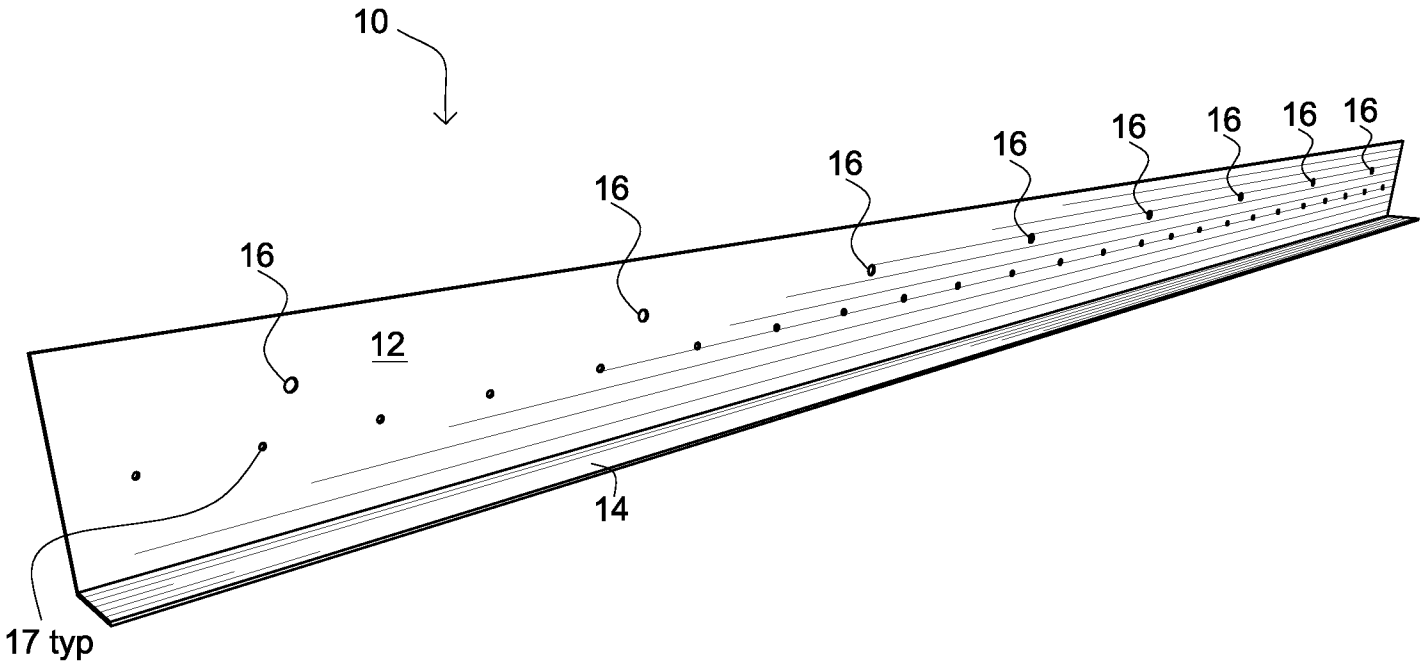
FIG. 2 is a perspective view of a L-bracket used to attach a lowered subfloor to a wall according to one embodiment of the present invention.
Figure 3:
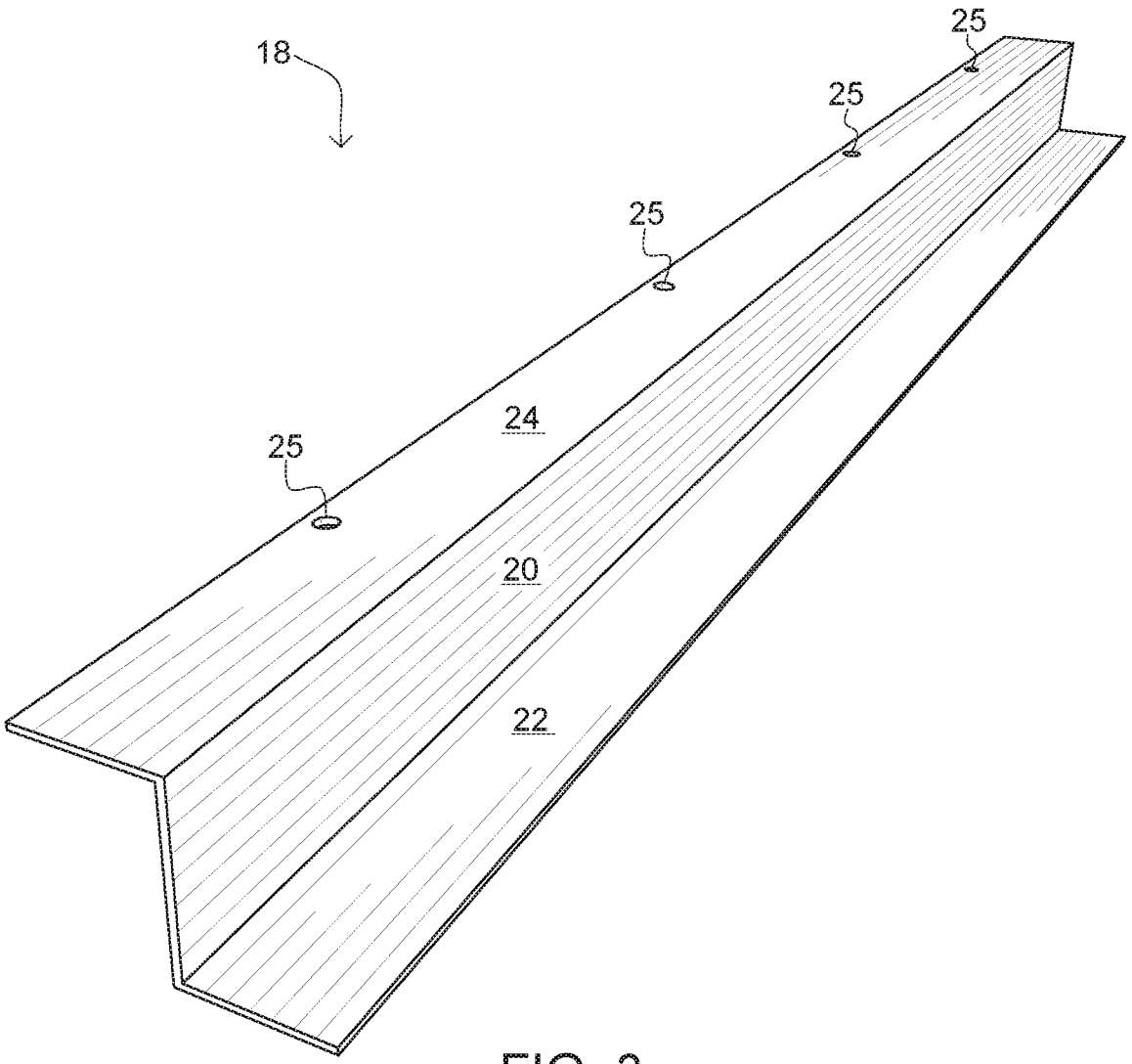
FIG. 3 is a perspective view of a Z-bracket used to attach a lowered subfloor to an adjoining normal height subfloor according to one embodiment of the present invention.

FIGS. 1-3 depict three types of brackets used to install a recessed subfloor into a room also having a normal or standard height subfloor. Typically, subfloor sheathing usually comprising comprises 23/32" thick oriented strand board (OSB) is installed on top of floor joists that are usually spaced 16" on center. By situating the subflooring sheets between floor joists instead of over them the subfloor can be effectively lowered up to 23/32" while maintaining the top surfaces of the joists themselves level with or below the top surface of the subfloor sheathing.

By lowering the subfloor in a bathroom in the region of the room that will comprise a shower stall, a sloped shower pan (custom or prefabricated) can be installed over the lowered subfloor wherein the resulting edges of the shower pan are level or close to level with the adjacent normal height subfloor. This allows for the uninterrupted installation of finish floor between the rest of the bathroom and the shower stall and permits the creation of a curbless transition there between.

Embodiments of the present system include one or more types of brackets configured to lower the subfloor a predetermined distance: an L-bracket 10 as shown in FIG. 2 designed for attachment to a shower wall; a Z-bracket 18 as shown in FIG. 3 for attachment to the top surface of a normal height subfloor sheet at an edge of the area where the subfloor is to be lowered; and a joist bracket 26 as shown in FIG. 1 for attachment to a floor joist in the area where the subfloor is to be lowered. In many if not most instances, all three brackets are utilized in conjunction with each other to lower a portion but not all of a subfloor in a room, although there are circumstances where only one or two of the bracket types are required.

The brackets can be comprised of any suitable material although brackets comprised of thinner sheet or plate are preferred. Accordingly, the brackets are typically made with a material having relatively high strength and high stiffness permitting thinner planar sections are preferred. Most commonly, the brackets are made of 14-18 gauge steel or stainless steel plate.

The dimensions of the brackets can vary, but embodiments of the set are configured so that when each is installed according to the described process the amount of subfloor drop offered by each relative to the top surface of a floor joist (or any other reasonable reference height) is the same for each bracket. For the specific embodiment(s) described herein, the dimensions given make the brackets suitable for use with standards for residential construction in the United States. As can be appreciated, the various dimensions can be easily adjusted for different construction materials and the standard dimensions of those materials in other embodiments. Pertinent standard dimensions of building materials that affect the dimensions of the illustrated embodiments include the 1½" thickness of a standard 2×4 framing stud and the 23/32" thickness of a standard sheet of OSB subfloor sheathing.

Figure 4:
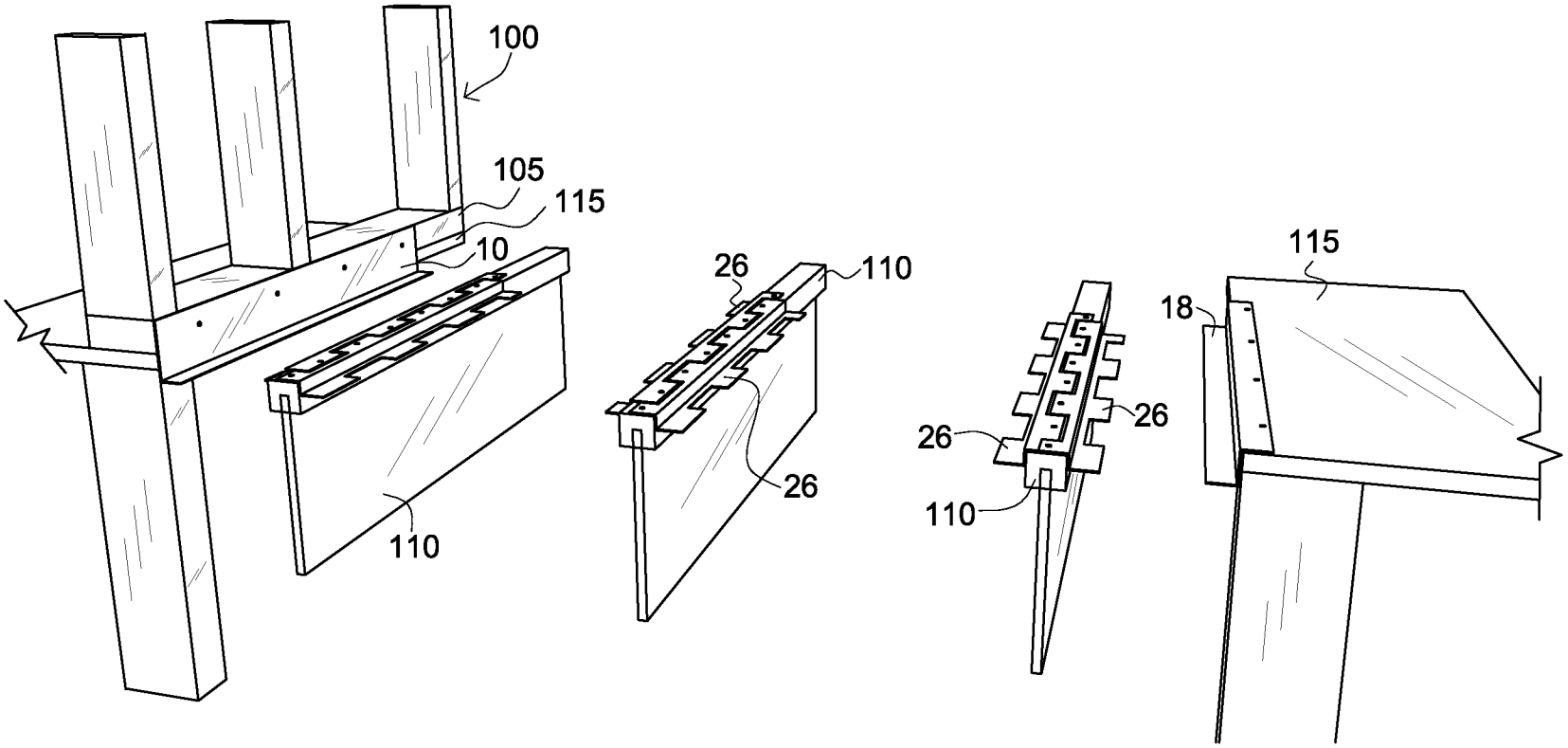
FIG. 4 is a perspective showing the three types of brackets installed and ready to accept a recessed subflooring according to one embodiment of the present invention.

The L-bracket 10 is illustrated in perspective in FIG. 2 and shown installed in the proper position against a framed wall 100 in FIG. 4. Significantly, the L-bracket comprises a substantially vertical leg 12 with a substantially horizontal flange 14 extending outwardly along a bottom edge of the vertical leg. A first series of horizontally aligned and evenly spaced bores 16 are provided along the length of the bracket to allow it to be secured to the sole plate of the wall framing typically with screws. Additional holes 17 can be provided in some embodiments below the spaced bores located at a position that permits small finish nails to be quickly and easily driven into the interface between the top surface of a normal height subfloor and the bottom surface of the 2×4 sole plate of the framed wall. These finish nails can help hold the bracket in place while the primary screws or nails are driven in the aforementioned bores 16.

Embodiments of the bracket can be provided in any desired length although about 46" is typical. As necessary, brackets can be butted up against each other for longer runs of the recessed subfloor along a wall. Further, longer lengths of bracket can be cut to fit in shorter wall runs. The width of the horizontal flange can vary although a depth of about one inch is typical. In certain embodiments, however, the height of the vertical leg critical in facilitating installation without requiring an installer to perform measurements and calculations to determine the specific placement of the bracket on the wall for a desired subfloor drop. Rather, by simply aligning the top edge of the vertical leg to be level with the top edge of the bottom horizontal 2×4 105 of a standard framed wall, the proper location of the horizontal flange is set.

In one embodiment, the length of the vertical leg from the top surface of the horizontal flange to the top edge of the leg is 2 about 45/64". Where the finished holes 17 are located 1 5/16" above the top surface of the horizontal flange and the finish nails are driven between the top of the flooring and the walls 2×4 header used, the horizontal flange will be located about 19/32" below the nominal top surface of the floor joists 110. As can be appreciated in real world construction, normal tolerances in both building materials and constructed walls and floors easily and regularly exceed 1/16 of an inch and as such dimensions measured to a 64th of an inch are somewhat theoretical and not representative of real world conditions. Nevertheless, brackets made to accommodate standard dimensions ultimately reduce the amount of remedial work required to accommodate deviations in the other materials resulting from deviations from normal dimensions and tolerance stack.

The evenly spaced horizontally aligned bore holes 16 can be provided about 11/16" down from top edge of the bracket to facilitate the bracket being secured into the wall typically through the 2×4 stud.

The Z-bracket 18 used to attach a lowered subfloor to an adjoining normal height subfloor is shown in FIG. 3. Additionally, the bracket is shown installed on a normal height subfloor 115 in FIG. 4. This bracket is used along edges of the recessed floor area that interface with portions of the associated room that have a standard or normal height subfloor installed. For use in typical structures built to U.S. construction standards, the bracket can comprise 16 or 18 gauge steel sheet that has been bent or otherwise formed into the illustrated Z shape.

The bracket 18 has a substantially vertical leg 20 having top and bottom edges. A substantially horizontal bottom flange 22 extends outwardly from the bottom edge and a substantially horizontal upper flange 24 extends outwardly from the top edge in the opposing direction relative to the bottom flange. Evenly spaced bore holes 25 are provided along the length of the upper flange for use in securing the bracket to the top of a normal height subfloor.

In one embodiment, the bracket 18 is comprised of 16 gauge steel, which is about 1/16" thick. The height of the vertical wall is 1⅜" from the top surface of the bottom flange to the top surface of the upper flange. This dimension will result in the top surface of the bottom flange being about 19/32" below the nominal top surface of the flooring joists 110.

The joist bracket 26 is illustrated in FIG. 1 and shown installed in FIG. 4. It is also Z-shaped with horizontal upper and lower flanges 28 & 30 extending from the top and bottom edges of the vertical leg 32. However, the height of the vertical leg, 21/32", is substantially less than that of the Z-bracket largely because the upper flange is received directly on a floor joist 110 instead of on top of a subfloor sheet mounted to a floor joist. For a bracket fabricated from 16 gauge steel, the top surface of the bottom flange is about 19/32" below the top surface of the floor joist when installed.

The upper flange of the joist bracket is characterized by a series of spaced tabs 34 separated by cutout sections 36 having at least a slightly greater length than the length of each tab. The lower flange is similarly configured comprising a series of alternating tabs 38 and cutout sections 40. Bore holes 42 for receiving fasteners are provided in the center of each upper flange tab for purposes of securing the bracket to the top surface of a floor joist. In another variation, additional bore holes 42 are provided through each upper flange tab giving an installer more options when attaching the upper flange to a joist permitting him/her to avoid any fasteners that may already have been driven into the joist.

With reference to FIG. 4, the purpose of the alternating tabs and cutouts of the upper flange can be understood. As shown, right and left (or first and second) joist brackets nest together on a single floor joist with the bottom flange of the left joist bracket extending outwardly to the left and the bottom flange of the right joist bracket extending outwardly to the right. By using tabs and corresponding cutouts each of the left and right joist brackets can be firmly secured to the floor joist with screws or nails proximate the longitudinal center of the joist for maximum purchase and strength. In typical embodiments, the joist brackets can be used on either the left or right side of a joist by simply rotating it 180 degrees.

In bathroom construction, it is sometimes desirable or necessary to double up floor joists or place floor joists mere inches apart instead of 16" apart. The tabs 38 and cutouts 40 on the lower flange allow face lower flanges of brackets mounted to adjacent but closely situated joists to intermesh.

In variations, a single joist bracket can be used with a c-shaped center portion that straddles the top of the joist and has both left and right bottom flanges the extend outwardly from the bottom edges of the c-shaped portion in opposite directions from each other. In another variation, the bottom flange may not include the tabs and cutouts and be similar to the bottom flange of the Z-bracket.

Figure 5A:
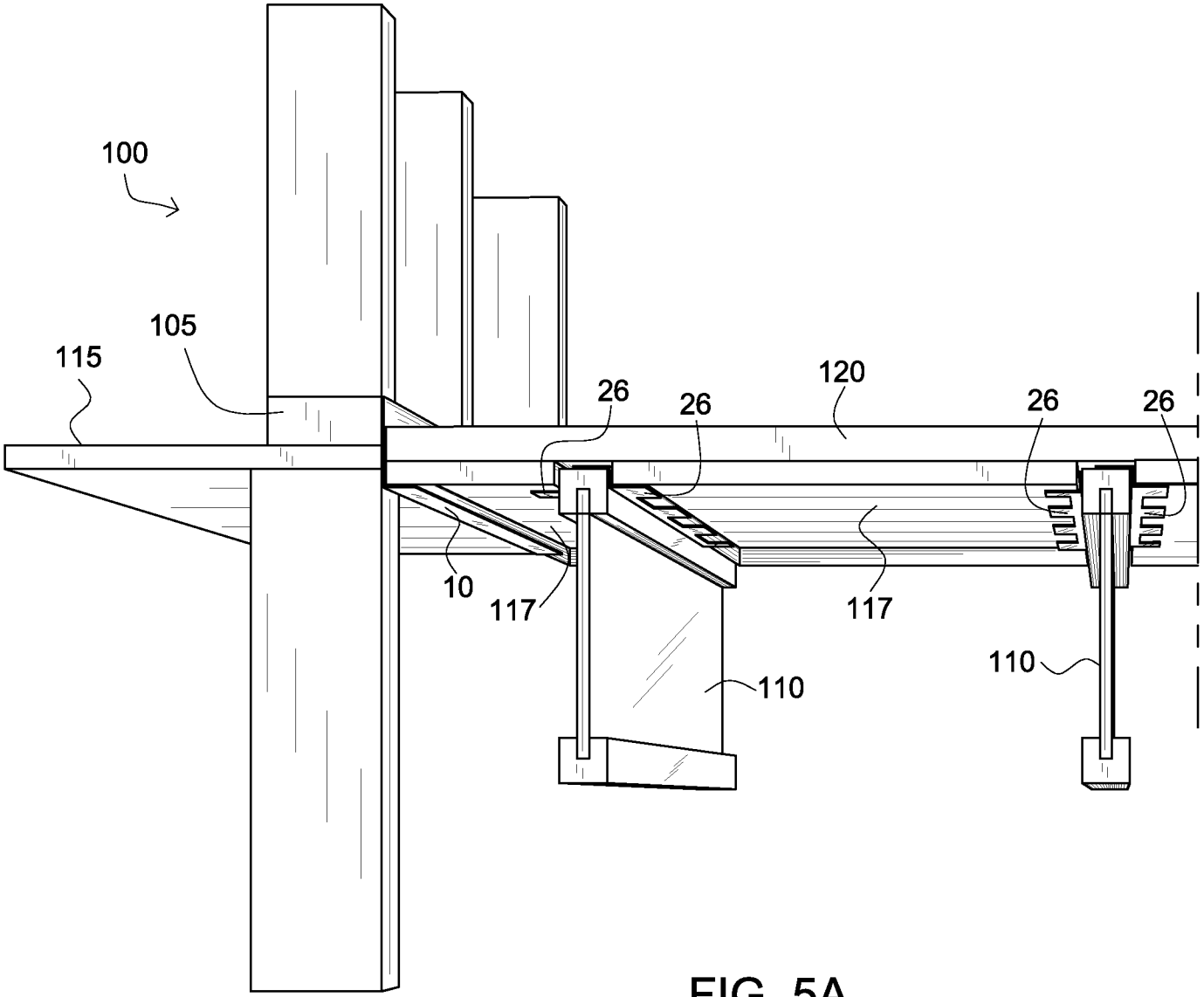
FIGS. 5A&B show a cross sectional perspective view of a shower stall with a recessed subfloor according to one embodiment of the present invention.
Figure 5B:
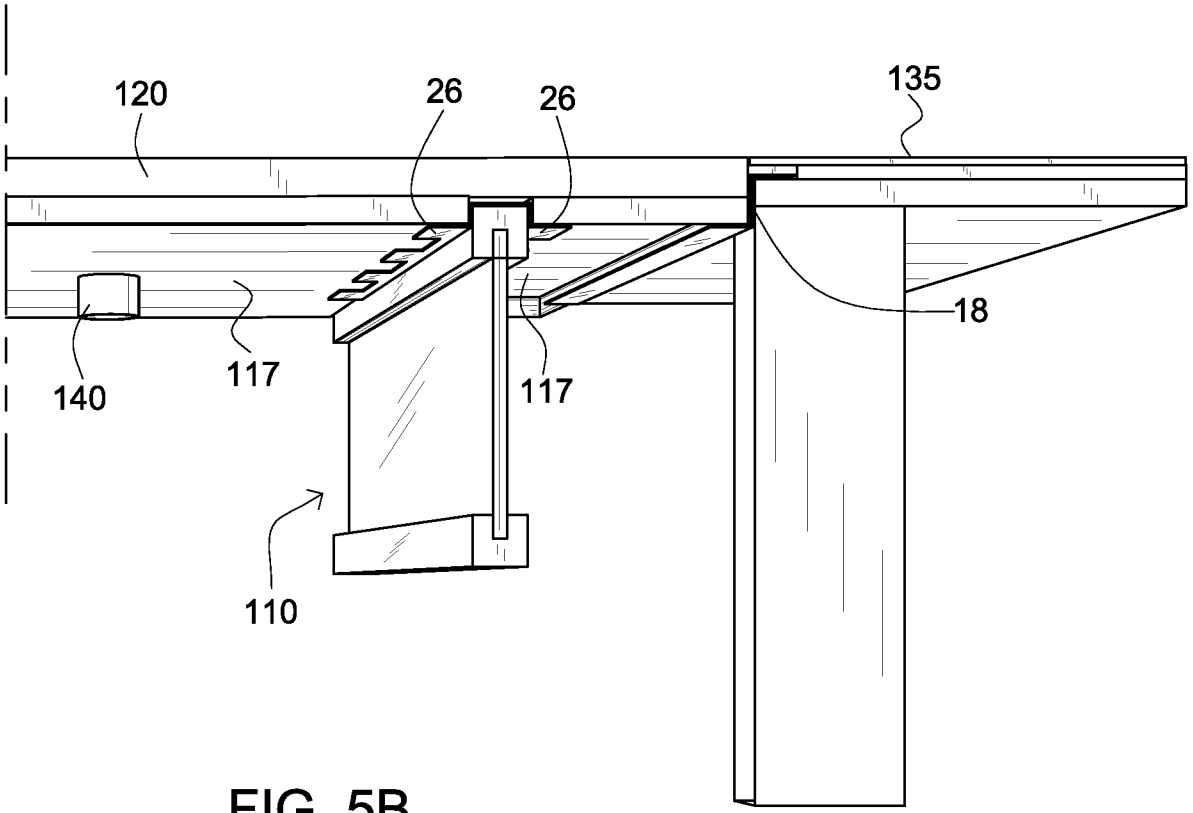

A side view/cross section of a curbless shower stall incorporating a recessed subfloor according to an embodiment of the present invention is illustrated in FIG. 5. The stall comprises three floor joists 110 on which joist brackets 26 have been secured. One edge of the stall abuts a normal height subfloor 115 to which a Z-bracket 18 is secured. Another edge of the stall abuts a wall 100. The wall includes a sole plate 105 sitting on top of the normal height subfloor 115. An L-bracket 10 is attached to the wall. Sheets 117 of recessed subfloor are secured to the bottom flanges of the various brackets. A shower pan 120 (either prefabricated or custom fabricated) rests on the recessed subfloor. As shown, the top edge of the shower pan is flush with the top surface of the finished floor 135 installed over the flooring normal height subfloor. As shown a drain 140 it installed in the shower stall floor. The drain can be any suitable type including a standard round drain or a linear drain.

In other variations, the shower pan can be thinner than the one illustrated in FIG. 5 wherein the top surface at the edges adjacent a normal height subfloor is flush with the normal height subfloor. Accordingly, the finish flooring can be installed across the interface between the stall and the rest of the bathroom uninterrupted and without a curb or lip.

A Method of Installing a Recessed Subfloor Using an Embodiment of the Floor Brackets The bracket set described above can be utilized in both new construction and retrofitting existing construction. The example described herein pertains to the installation of a recessed subfloor for receiving a curbless shower stall installation thereon; however, the bracket set and associated methods can be used in any room in which at least a portion of the room's subfloor is to be recessed.

Initially, the area of a bathroom in which the shower stall is to be received is determined either before or after the installation of a normal height subfloor. Wherein a normal height subfloor has already been installed, it is removed in the region receiving the recessed subfloor. In installations where the normal height subfloor has not been installed, it is installed in all areas of the room excepting the area receiving the recessed subfloor. As necessary, any walls that will form the boundaries of the stall are framed.

Next, the various brackets from the set are installed. The order of installation is not typically critical and depending on manpower the different brackets can be installed contemporaneously. One or more L-brackets 10 are installed against the walls of the shower stall. The brackets can be provided in a standard length or lengths but where the standard length is too long the brackets can be cut to a desired size. Wherein the framed wall is attached directly to a normal height subfloor and comprises a 2×4, 2×6 or other 2× sole plate the installer need only align the top edge of the bracket's leg flush with the top surface of the sole plate to ensure the bottom flange will be located at the proper depth for the recessed subfloor. Alternatively or additionally, the installer can drive small finish nails through the provided holes 17 and into the interface between the top of the normal height subfloor and the bottom of the sole plate. Provisionally securing the L-bracket to the walled edge this way will also set the bracket's lower flange at the proper depth. Once positioned, the bracket is screwed or nailed in place through the provided primary bore holes 16.

One or more Z-brackets 18 are installed along edges of the boundaries of the stall comprising normal height subfloor. The brackets can be provided in a standard length or lengths but where the standard length is too long the brackets can be cut to a desired size. The bracket(s) are positioned against and on the edge of the normal height subfloor and screwed or nailed into place through the provided bore holes.

The joist brackets 26 are identified as right or left brackets and cut to size as applicable. The brackets are usually pre-fit before being secured in place to ensure that the brackets properly nest and ensure that the brackets cover most if not substantially all of the length of the joists. Once positioned, the joist brackets are secured in place with nails or screws. Like with the L and Z brackets the bottom flanges of the joist brackets will be located at the proper depth to receive the recessed subfloor sheets.

Sheets of subflooring are cut to the proper width and length and placed onto the bottom flanges of the installed brackets. The subfloor sheeting can be secured to the flanges with adhesive or drilled and screwed in place as desired. Next, a prefabricated or custom shower pan of the appropriate thickness along its edges such that the surface of the pan adjacent the surface of the normal height subfloor is flush with the normal height subfloor or will be flush with finish flooring once it is installed over the normal height subfloor. As applicable, finish flooring, such as tile, can be installed over the shower pan and the normal height subfloor as necessary or desired spanning across the delineation between the normal height subfloor and the shower pan surface.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

It is to be appreciated that the specific dimensions provided herein are done so by way of example. Variations of the brackets can be designed and fabricated to recess the subfloor any desired dimension for any desired purpose.

I claim:

1. A floor of a shower stall, the floor including:

a combination of elongated brackets for recessing a portion of a subfloor in a room a predetermined amount relative to subflooring attached to a top surface of floor joists spanning across the room, the combination of brackets comprising at least:

an elongated L-bracket having a substantially vertical planar L-bracket leg extending upwardly from an intersection along a bottom edge with a substantially horizontal planar L-bracket flange, the substantially vertical planar L-bracket leg having a first height;

an elongated Z-bracket having a substantially planar vertical Z-bracket leg extending (i) upwardly from an intersection along a bottom edge with a substantially horizontal planar Z-bracket bottom flange, and (ii) downwardly from an intersection along a top edge with a substantially horizontal planar Z-bracket upper flange, the substantially vertical planar Z-bracket leg having a second height; and elongated first and second joist brackets, each joist bracket being Z-shaped and comprising a substantially planar joist bracket vertical leg extending (i) upwardly from an intersection along a bottom edge with a substantially horizontal planar joist bracket bottom flange, and (ii) downwardly from an intersection along a top edge with a substantially horizontal planar joist bracket upper flange, the substantially vertical planar joist bracket leg having a third height, the joist bracket upper flange comprising a plurality of evenly spaced outwardly extending tabs further defining a plurality of cutouts between the tabs, the tabs of the first joist bracket configured to nest in the cutouts of the second joist bracket and the tabs of the second joist bracket configured to nest in the cutouts of the first joist bracket when installed on opposing sides of a floor joist;

at least one floor joist;

at least one shower stall wall;

at least one edge abutting a normal height subfloor;

wherein (i) the L-bracket is secured to the at least one shower stall wall, (ii) the Z-bracket is secured to the normal height subfloor at the at least one edge of the floor, and (iii) the first and second joist brackets are nested and secured to the at least one floor joist on opposing sides thereof.

2. The combination of claim 1, wherein the first, second and third heights are each different from each other.

3. The combination of claim 1, wherein the L-bracket leg includes a first plurality of L-bracket bores spaced along a length of the L-bracket at a first bore height.

4. The combination of claim 3, wherein the L-bracket leg includes a second plurality of L-bracket bores spaced along the length of the L-bracket at a second bore height.

5. The combination of claim 1, wherein the Z-bracket upper flange includes a plurality of Z-bracket bores spaced along a length of the Z-bracket.

6. The combination of claim 1, wherein the tabs of the first and second joist brackets each include at least one tab bore extending there through.

7. The combination of claim 1, wherein each of the L-bracket, the Z-bracket and the joist brackets are comprised of plate steel.

8. The combination of claim 1, wherein (1) the L-bracket leg includes a plurality of L-bracket bores spaced along a length of the L-bracket, (2) the Z-bracket upper flange includes a plurality of Z-bracket bores spaced along a length of the Z-bracket, and (3) the tabs of the first and second joist brackets each include at least one tab bore extending there through.

9. The combination of claim 4, wherein the first height is about $2\frac{47}{64}$", the second height is about $1\frac{11}{32}$", and the third height is about $\frac{19}{32}$".

10. The floor of a shower stall of claim 1, wherein top surfaces of the L bracket flange, the Z-bracket bottom flange, and the joist bracket bottom flanges are about planar with each other.

11. The floor of the shower stall of claim 10, further comprising one or more sheets of shower stall subflooring, the one or more sheets of shower stall subflooring installed over one or more of the L-bracket, the Z-bracket and the joist brackets;

wherein top surfaces of the one or more sheets of shower stall subflooring are about even with top surfaces of the Z-bracket upper flange and the joist bracket upper flanges.

12. The floor of the shower stall of claim 11, further including a shower pan, the shower pan being installed over the one or more sheets of shower stall subflooring.

13. The floor of the shower stall of claim 12, wherein a perimeter edge of the shower pan located adjacent the normal height subfloor is even in height with the normal height subfloor.

14. The floor of the shower stall of claim 12, wherein a perimeter edge of the shower pan located adjacent a normal height subfloor of a surrounding bathroom is even in height with finish flooring installed on top of the normal height subfloor.

15. A method of installing a combination of elongated brackets in a bathroom to facilitate the creation of a shower stall having a recessed subfloor, the method comprising:

providing the combination of elongated brackets, the combination of elongated brackets including:

an elongated L-bracket having a substantially vertical planar L-bracket leg extending upwardly from an intersection along a bottom edge with a substantially horizontal planar L-bracket flange, the substantially vertical planar L-bracket leg having a first height;

an elongated Z-bracket having a substantially planar vertical Z-bracket leg extending (i) upwardly from an intersection along a bottom edge with a substantially horizontal planar Z-bracket bottom flange, and (ii) downwardly from an intersection along a top edge with a substantially horizontal planar Z-bracket upper flange, the substantially vertical planar Z-bracket leg having a second height; and elongated first and second joist brackets, each joist bracket being Z-shaped and comprising a substantially planar joist bracket vertical leg extending (i) upwardly from an intersection along a bottom edge with a substantially horizontal planar joist bracket bottom flange, and (ii) downwardly from an intersection along a top edge with a substantially horizontal planar joist bracket upper flange, the substantially vertical planar joist bracket leg having a third height, the joist bracket upper flange comprising a plurality of evenly spaced outwardly extending tabs further defining a plurality of cutouts between the tabs, the tabs of the first joist bracket configured to nest in the cutouts of the second joist bracket and the tabs of the second joist bracket configured to nest in the cutouts of the first joist bracket when installed on opposing sides of a floor joist;

installing the L-bracket by securing the L-bracket leg to a shower stall wall;

installing the Z-bracket by securing the Z-bracket upper flange to a normal height subfloor bounding the edge of the shower stall; and installing the first and second joist brackets on a floor joist by nesting the tabs of each in the cutouts of the other and securing the joist bracket upper flanges to a top surface of the floor joist.

16. The method of claim 15, further comprising:

installing sheets of subflooring over opposing flanges of the L-bracket flange, the Z-bracket bottom flange, and the joist bracket bottom flange.

17. The method of claim 16, further comprising:

installing a shower pan over the subflooring; and installing finish flooring over the shower pan.

* * * * *